US005437442A

United States Patent [19]

Petersen

[11] Patent Number: 5,437,442

[45] Date of Patent: Aug. 1, 1995

[54] SINGLE OR PLURAL SHEET FOLDING APPARATUS FOR USE WITH ROTARY PRINTING PRESSES

[75] Inventor: Godber Petersen, Augsburg, Germany

[73] Assignee: Man Roland Druckmaschinen AG, Offenbach am Main, Germany

[21] Appl. No.: 90,753

[22] Filed: Jul. 13, 1993

[30] Foreign Application Priority Data

Jul. 17, 1992 [DE] Germany ..... 42 23 524.3

[51] Int. Cl.[6] ..... B65H 45/12; B41F 13/62

[52] U.S. Cl. ..... 270/45; 270/20.1; 493/416

[58] Field of Search ..... 493/416, 436, 437, 444, 493/445; 270/32, 45, 18, 19, 20.1, 251

[56] References Cited

U.S. PATENT DOCUMENTS

| | | | |
|---|---|---|---|
| 1,085,280 | 1/1914 | Maley | 493/444 |
| 3,117,777 | 1/1964 | Funk | 493/444 |
| 3,749,394 | 7/1973 | McCain et al. | 493/444 X |
| 4,388,073 | 6/1983 | Klenk | 493/444 |
| 4,516,759 | 5/1985 | Koblerer . | |
| 4,605,212 | 8/1986 | Kobler . | |
| 4,775,136 | 10/1988 | Petersen . | |
| 4,840,365 | 6/1989 | Kobler et al. . | |
| 4,909,779 | 3/1990 | Schaffron | 493/445 X |
| 4,949,948 | 8/1990 | Petersen . | |
| 5,067,697 | 11/1991 | Honegger | 270/32 X |
| 5,106,068 | 4/1992 | Honnegger | 270/32 X |
| 5,110,116 | 5/1992 | Kobler et al. . | |
| 5,129,781 | 7/1992 | Petersen . | |

FOREIGN PATENT DOCUMENTS

| | | |
|---|---|---|
| 0358065 | 3/1990 | European Pat. Off. . |
| 3621832 | 9/1987 | Germany . |

OTHER PUBLICATIONS

Patent Abstracts of Japan—vol. 10, No. 193 (M-496) (2249) Jul. 8, 1986 & JP-A-61 037 667 (Hitachi Seiko) Feb. 22, 1986.

*Primary Examiner*—John E. Ryznic
*Attorney, Agent, or Firm*—Frishauf, Holtz, Goodman & Woodward

[57] ABSTRACT

In a folding apparatus that follows web-fed rotary printing presses, folded or unfolded sheets (9) are folded after the printed web has been severed. The folded or unfolded sheets (9) are delivered in parallel from a transport apparatus with a gripper chain or with storage cassettes and are folded simultaneously in folding units (8).

18 Claims, 10 Drawing Sheets

SINGLE OR PLURAL SHEET FOLDING APPARATUS FOR USE WITH ROTARY PRINTING PRESSES

Reference is made to the following related patents, assigned to the assignee of the present invention, the disclosure of which is hereby incorporated by reference:

U.S. Pat. No. 4,516,759 issued May 14, 1985
U.S. Pat. No. 4,840,365 issued Jun. 20, 1989
U.S. Pat. No. 5,110,116 issued May 5, 1992
U.S. Pat. No. 5,129,781 issued Jul. 14, 1992

The present invention relates to a folding apparatus for rotary printing presses to which individual folded sheets or packages of folded sheets also referred to as folded products can be delivered serially. When reference is made hereinafter and in the claims to "sheet", it is to be understood that the singular form is used merely for convenience and is to include packages of sheets, for example, numerous folded sheets, for instance newspapers.

BACKGROUND

Folding apparatuses for web-fed rotary printing presses are well-known. One such folding apparatus is described in U.S. Pat. No. 4,516,759. In it, folded sheets are delivered via a first, higher speed belt system to a retarding path, the belt system being close to the printing press and having upper and lower belts. The folded sheets are delivered to a second, lower-speed belt system farther from the printing press and again having upper and lower belts, or to a pair of folding rollers. The folded sheets are processed in succession, or in other words serially. This makes it necessary to deliver them in a precisely defined manner to the folding apparatus, and to assure, for instance with the aid of the retarding path described therein, a certain speed of the folded samples as they pass through the folding apparatus. A folding apparatus of this kind, at relatively high processing speeds, rapidly reaches its limit capacity depending on the type of fold and the type of paper. Since the associated web-fed rotary printing press as a rule has a higher capacity than the folding apparatus following it, this means that the web-fed printing press cannot be run at top speed.

U.S. Pat. No. 4,840,365 issued Jun. 20, 1989 discloses an apparatus for receiving and conveying folded products in which the folded products are stored next to one another. An approximately zig-zag carrier structure, made of plates which, by way of example, are elastic and which are welded at the contact points with one another, can be transported along guide rails. The carrier structure can be taken from an empty storage means in its compressed form and then pulled or pushed into an unloading, loading or mixing zone, where the spread-apart carrier structure is ready to receive folded products. After that, the folded products can be compactly stored in a storage means on or in the carrier structures.

THE INVENTION

It is an object of the present invention to create a folding apparatus that is suitable for fast processing of folding products as well.

Briefly, in such a folding apparatus, a number of folding units are provided. The folded sheets are deliverable to the folding units in parallel, in a direction substantially perpendicular to the direction of serial delivery, and can be simultaneously folded in parallel therein. The maximum number of parallel-deliverable folding sheets is equivalent to the number of folding units. The apparatus according to the invention serves to fold sheets which may have been folded in a previous folding process, or may be unfolded sheets.

A roller-fed rotary printing press preceding the folding apparatus of the invention can accordingly be operated at maximum speed. At the same time, the folding apparatus assures high quality with a high throughput of folded samples.

The invention is described below in further detail in terms of an exemplary embodiment, taken in conjunction with the drawings.

Drawings

Detailed Description

Figure 3:
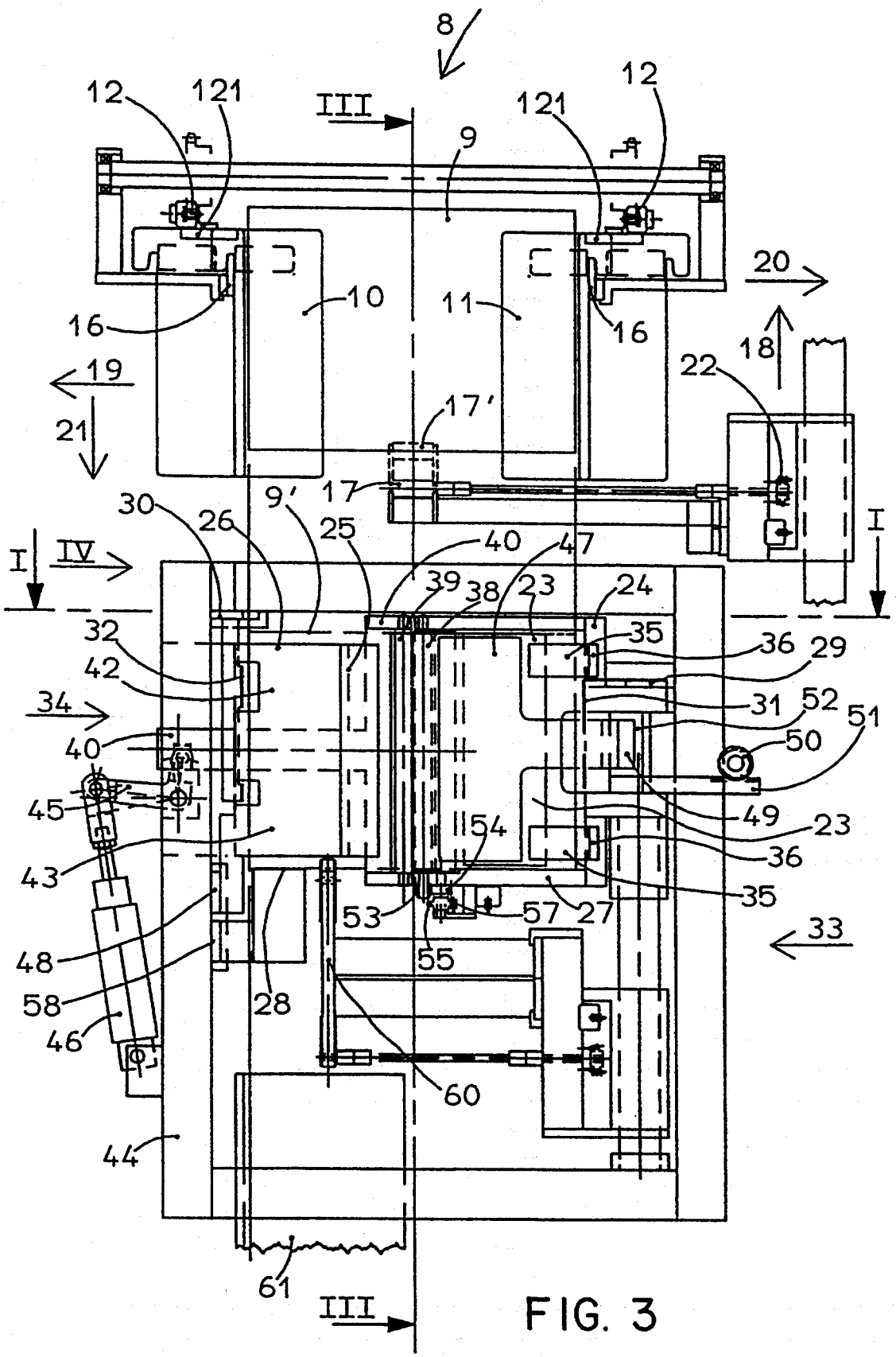
FIG. 3 is a front view of a folding unit.

In a transport apparatus 1 (FIG. 1), folded sheets 9, which initially are stacked one above the other on a stack 2, are taken individually from the stack 2 by a gripper chain 3 in a manner known per se (U.S. Pat. No. 5,110,116). Instead of the individual folded sheets 9, stacks of folded sheets may also be taken. The gripper chain 3 has gripper units 300 with stops 301. Depending on the spacing of the gripper units 300, the folded sheets 9, which are suspended from the gripper chain 3, are equi-distant from one another, and are transported in the direction of an arrow 4 to folding units 8 (FIG. 3). Above the folding units, the gripper chain 3 is stopped for a brief period of time. A trip rail 5 with projections 501 that engage the stops 301 from behind is disposed above the gripper chain 3 and is moved either sequentially or simultaneously in the direction of arrows 6 and 7 to the gripper chain 3, so that the stops 301 are opened by the projections 501. As a result, the folded sheets 9 are delivered simultaneously to the various folding units 8.

Figure 1:
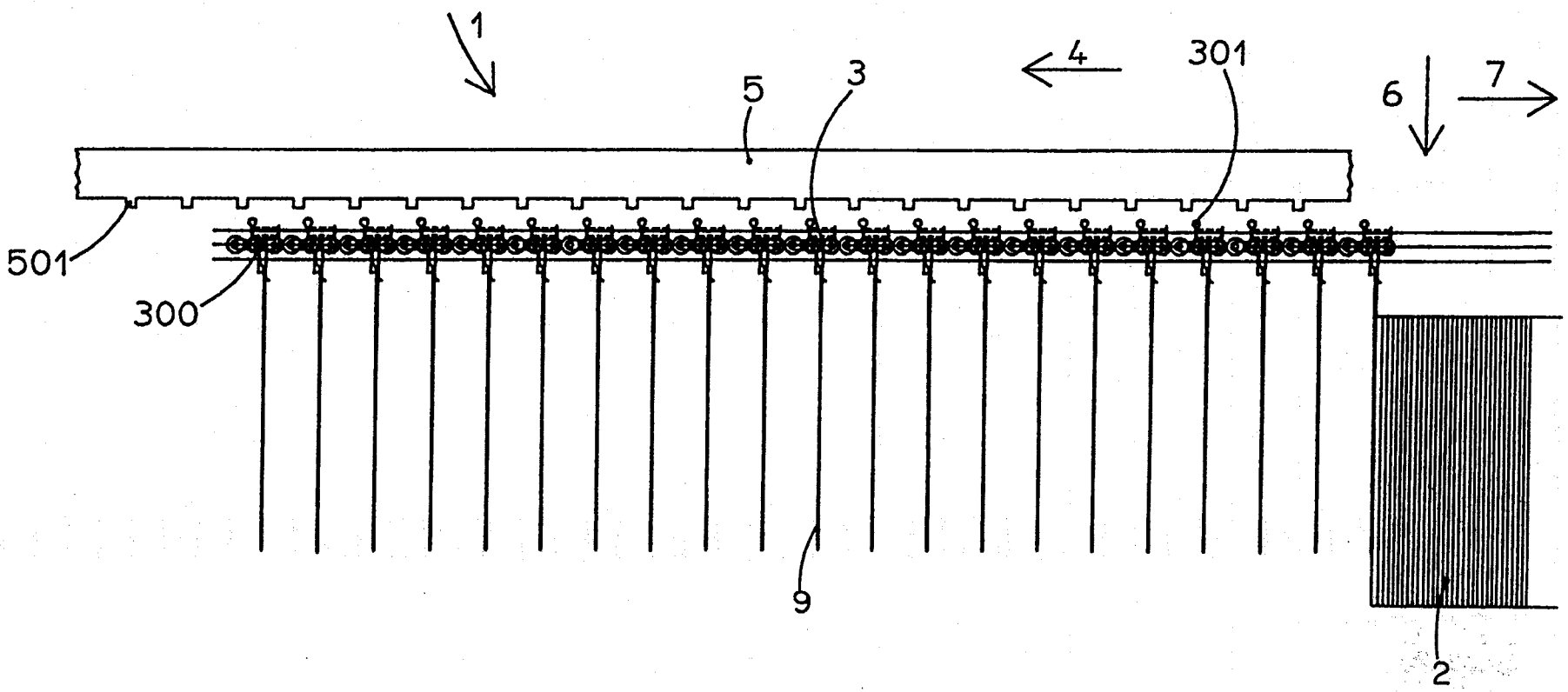
FIG. 1 is a side view of a transport apparatus with a gripper chain.

Instead of the transport apparatus 1 of FIG. 1, a transport apparatus 14 with storage cassettes 140 (FIG. 2) may also be provided. Then, already once-folded sheets 9 are located in zig-zag carrier structures 10, 11 in a manner known per se from the aforementioned U.S. Pat. No. 4,840,365. With the aid of pullers 121 located on transport chains 12, 13, the folded sheets 9 are pulled out of the carrier structures 10, 11 with the storage cassettes 140 onto rails 16 in the direction of an arrow 15. The carrier structures 10, 11 have spacers 100, by which the folded sheets are kept uniformly spaced apart from one another. Next, the carrier structures 10, 11, with the folded sheets 9, are each put in a position above the folding units 8 (FIG. 3).

Figure 2:
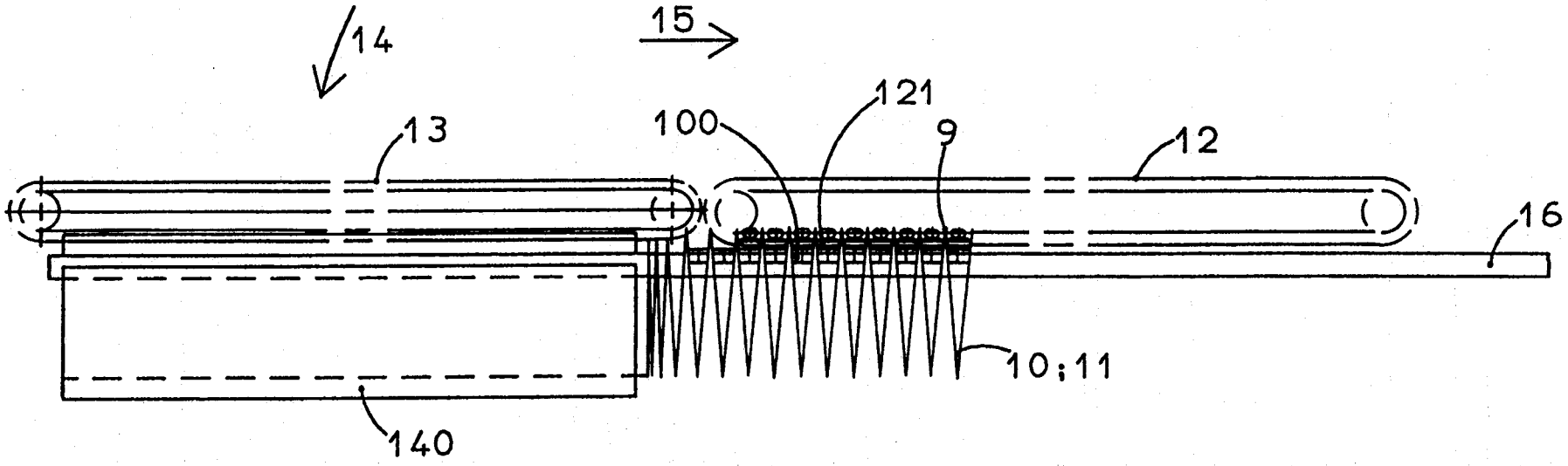
FIG. 2 is a side view of a transport apparatus with a cassette.

Turning now to FIG. 3, each of the folding units 8 has one pair of transport rollers 17, which can be moved in the direction of an arrow 18 into a position 17'. The transport rollers 17 are pressed together simultaneously, so that they grip the folded sheet 9. At the same time, the folded sheet 9 is released by moving the carrier structures 10, 11 apart in the direction of arrows 19, 20. Although FIG. 3 shows delivery of folded sheets 9 to folding units 8 with carrier structures 10, 11 as shown in FIG. 2, such delivery can likewise be accomplished with the arrangement shown in FIG. 1. In such case, sheets 9 are released as stops 301 are opened by projections 501. The following description will only refer, however to the use of the cassette arrangement depicted in FIG. 2.

The folded sheet 9 shown in FIG. 3 is then transported in the direction of the arrow 21 until it assumes a position 9'. The folded sheet 9 slides laterally along plates 23, 24, 25, 26 until it comes to rest between them in the position 9', supported by its lower edge on stops 27, 28. The folded sheet 9 is also aligned by stops 31 and 32, which are secured to the rails 29, 30. Rails 29, 30 and stops 31 and 32 are arranged for movement in opposite directions from one another, as indicated by arrows 33 and 34. The plates 23 are each secured to rails 36 via elastic tongues 35.

One folding apparatus has a number of folding units 8, which are disposed next to one another, so that when the folded sheets 9 are delivered in the direction of arrow 21 substantially at right angles to the direction of serial delivery of the folded sheets 9, as indicated by arrows 4 and 15, the folded sheets 9 will be picked up in parallel and simultaneously. The direction of the parallel pickup may, however, deviate by ±10° from that indicated by the arrow 21.

The folding units 8, as already indicated above, are located next to one another (FIG. 4), so that the folded sheets 9 will be picked up simultaneously with the carrier structures 10, 11 via the transport rollers 17. Once the folded sheets 9 rest with their lower edge on the stops 27, 28, the plates 23 are moved along the rails 36 in the direction of an arrow 37 (FIG. 5), and by this means half of each folded sheet 9 in each case is pressed against the plates 24 and held in place by them.

Figure 4:
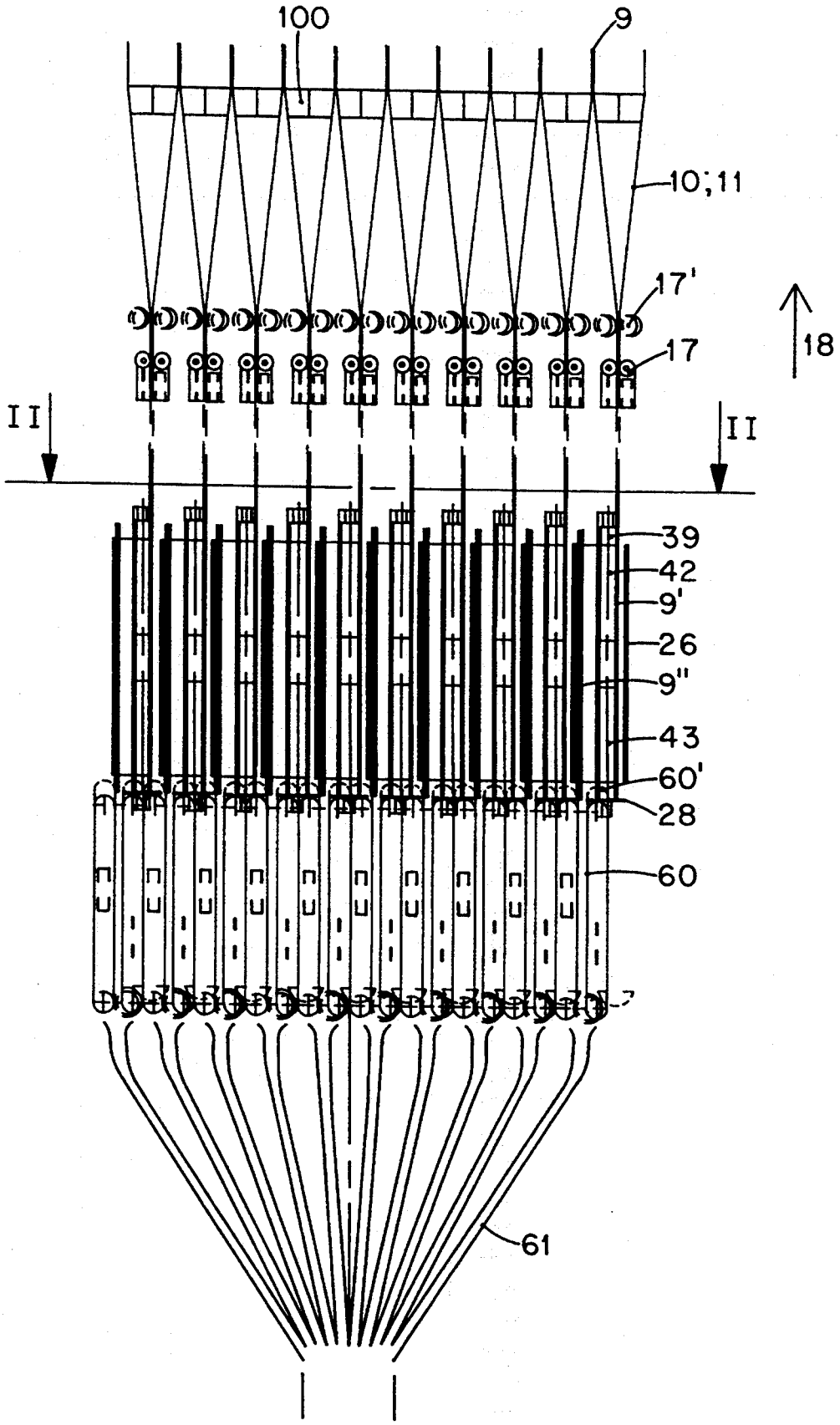
FIG. 4 is a side view of a multiple folding system.
Figure 5:
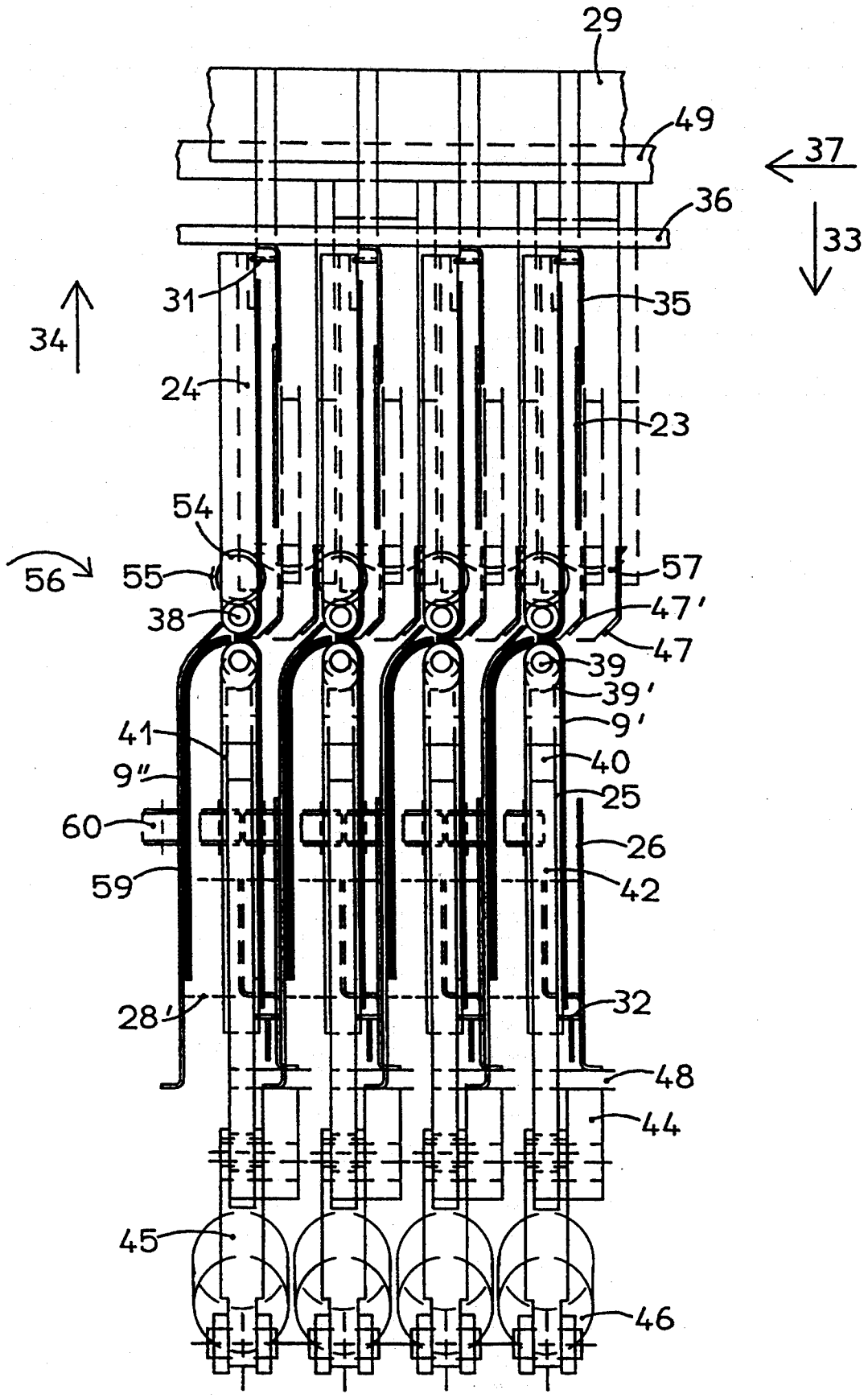
FIG. 5 is a sectional view taken along a line I—I of FIG. 3 and a line II—II of FIG. 4.

The folding units 8 each have a folding roller 38, which is supported in a fixed position, but rotatably, in the associated plate 24. Each of the folding rollers 38 is provided with a corresponding folding roller 39 that is likewise rotatably supported in a fork-like mount 40. Because of the mount 40, however, the folding roller 39 is movable laterally as well. The mount 40 is longitudinally displaceably guided between the plates 25 and plates 41 as well as blocks 42 and 43 (FIG. 4). Each of the blocks 42, 43 is secured to a carrier 44 (FIG. 5). The folding rollers 39 can be moved via the mount 40 and a lever 45, which is also supported on the carrier 44, by means of a cylinder 46 operated pneumatically, for instance.. Once the plates 26 have been moved by a common rail 48 in the direction of the arrow 37 far enough toward the plates 25 that the folded sheets 9 are kept taut as they enter the folding blades 47, the folding rollers 39 are moved into a position 39' to make it easier to press in on the folded sheets 9 with the folding blades 47. Only one-half of folded sheets 9 (that is, the lower half as seen in FIG. 5) is moved away in the direction 34, while the other half (that is, the upper half) remains clamped between the plates 23 and 24, so that accurate folding is attained. The folding blades 47 are secured jointly to a rail 49 (see FIG. 3) and are moved in the direction of the arrow 37 (FIG. 5) into a position 47', so that the bent ends of the folding blades 47 drive into the folded sheets 9 and press them inward.

In order to adjust the folding blades 47 centrally between the folding rollers 38, 39 for any thickness of folded sheets 9, the folding blades 47 are disposed in such a way by pinions 50 and racks 51 via guides (see FIG. 3) that they can be moved in the direction of the arrow 37. Then the folding rollers 39 are moved out of the position 39' by the cylinders 46 in the direction of the arrow 34 to the position 39, where at the conclusion of the folding process they produce the folding crease.

Figure 6:
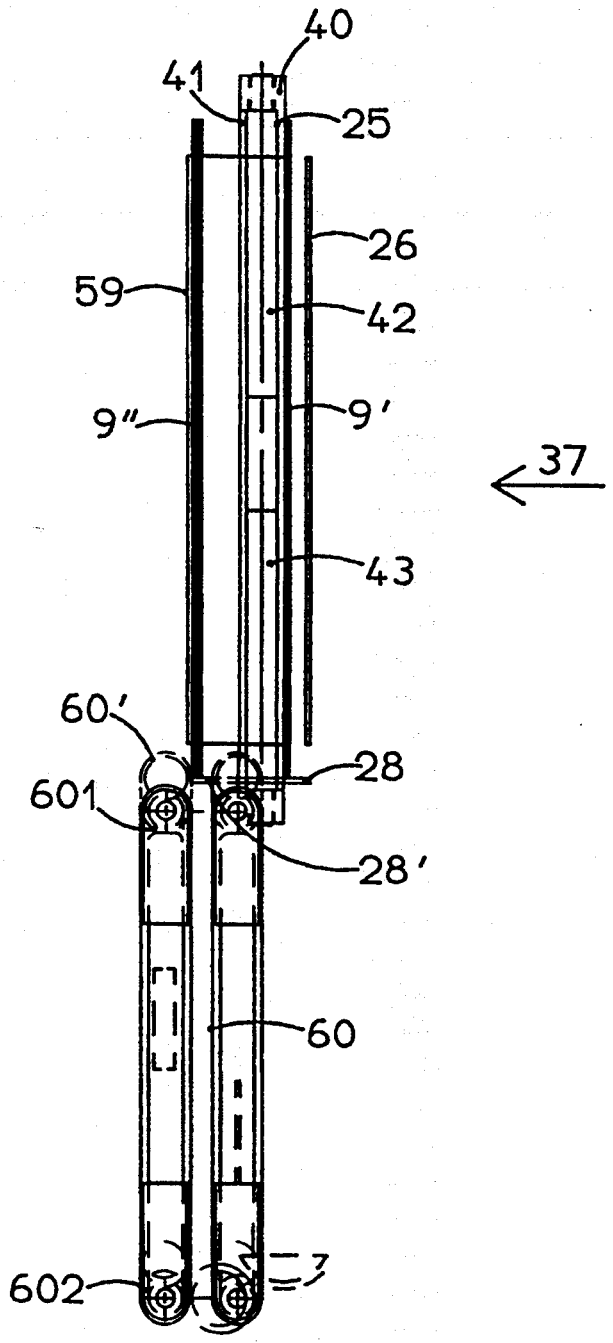
FIG. 6 is a detail of FIG. 4 on a larger scale.
Figure 7:
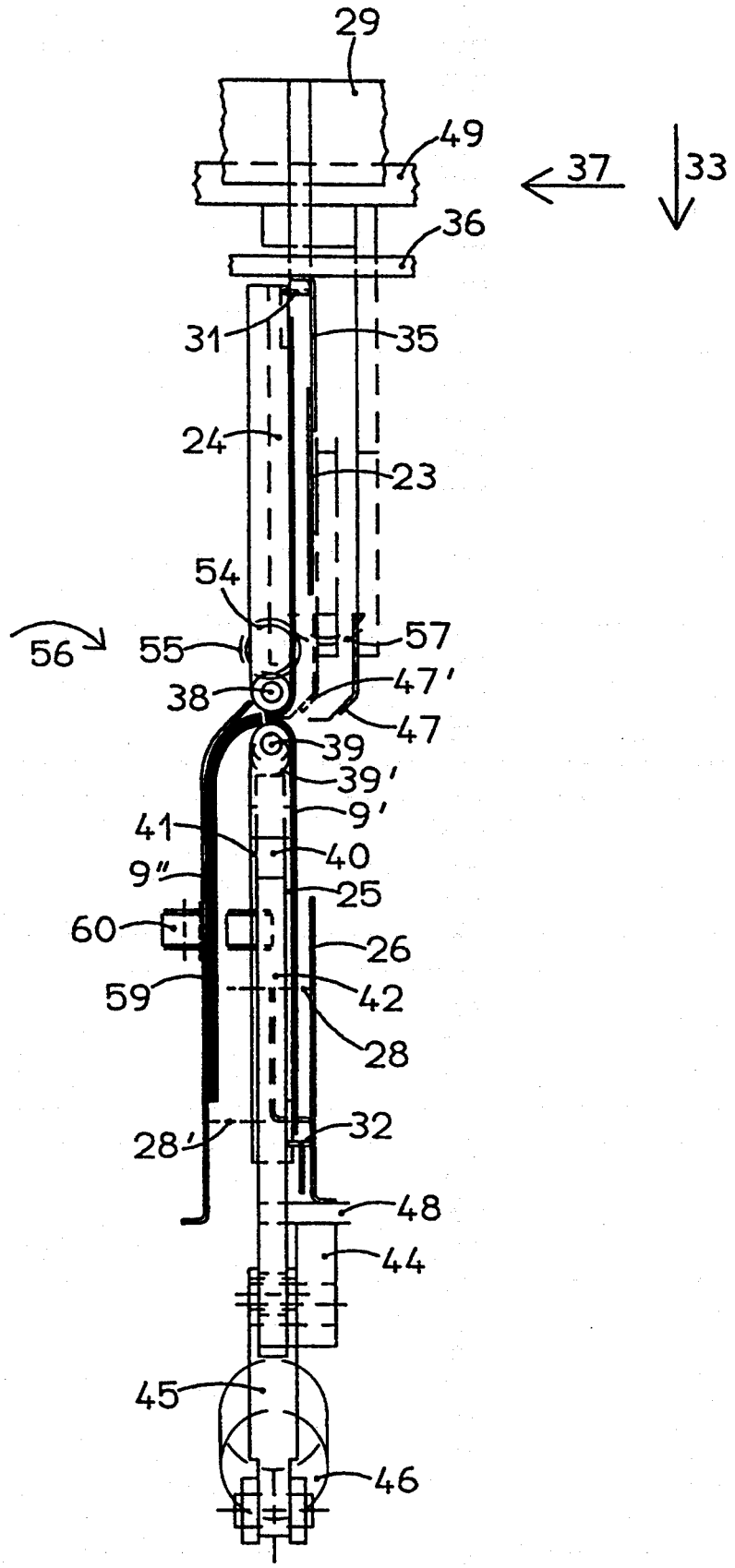
FIG. 7 is a detail of FIG. 5 on a larger scale.
Figure 8:
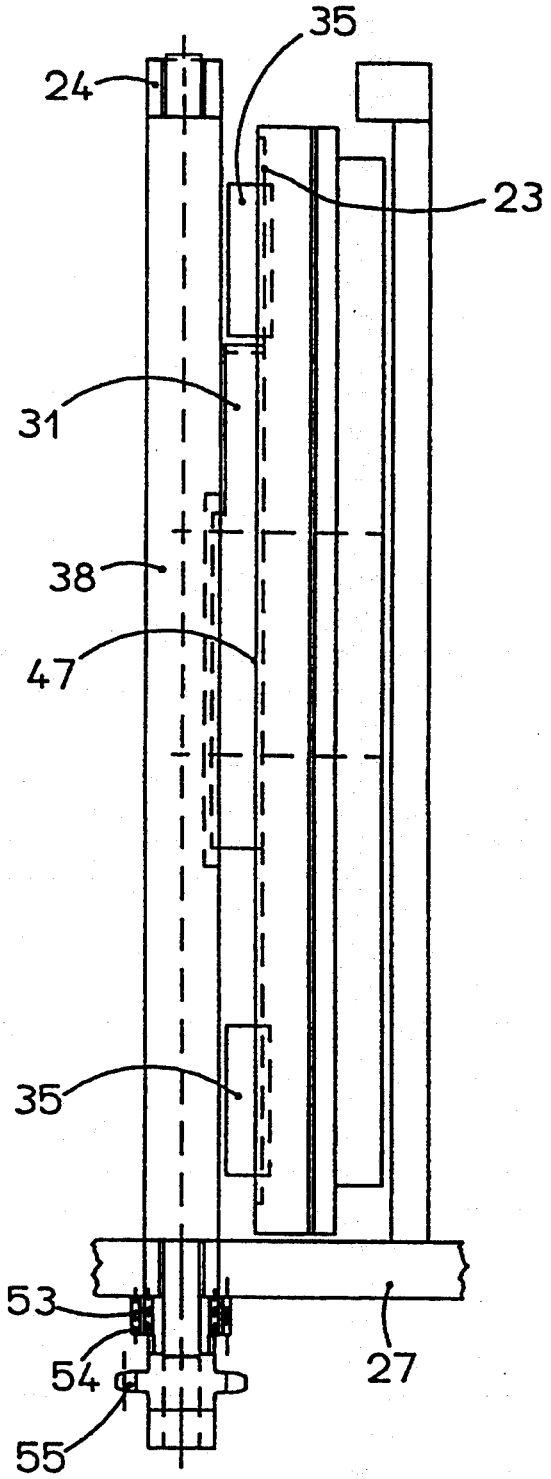
FIG. 8 is a sectional view taken along a line III-III of FIG. 3.
Figure 9:
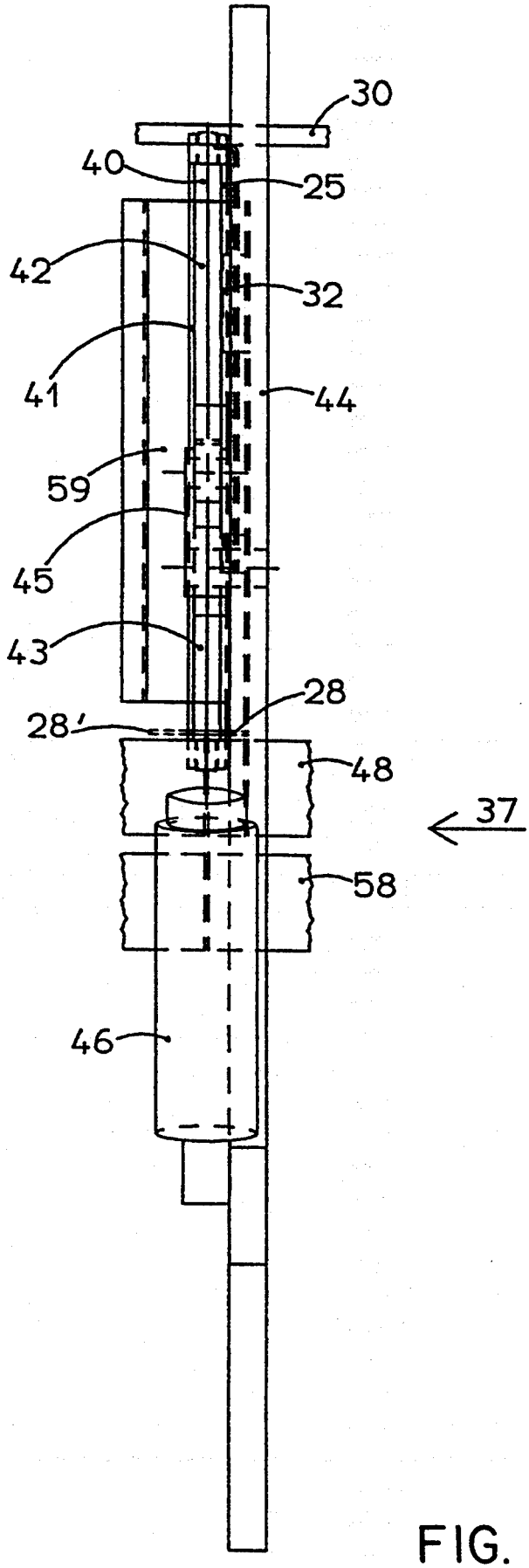
FIG. 9 is a view in the direction of an arrow IV of FIG. 3.

Once the folding process is concluded, that is, once the folding crease has been made, the air pressure in the cylinders 46 is controlled so that the folded sheets 9 are transported onward by the rotation of the folding rollers 38, 39. At the same time, the folding blades 47 are retracted from the positions 47' back to their initial position. The stops 28 (FIG. 3) are moved over a common rail 58 into a position 28' (FIG. 5), in order to support the already folded sheets 9. At the same time, the folding rollers 39 are driven via spur gears 53, 54 and chain wheels 55 (FIGS. 3, 5, 8) in the direction of an arrow 56 (FIGS. 5, 7), while the folding rollers 38 are set into motion by friction with the folded sheets 9. The chain wheels 55 are driven via a common chain 57 (FIGS. 5, 7). As a result, the creased folded sheets 9 reach a position 9'' between the plates 41 and plates 59, as can be seen particularly in FIGS. 6 and 7. In this position, the folded sheets 9, once the stops 28 (FIG. 9) have been retracted from the position 28' to the outset position 28, are engaged by pairs of toothed belts 60 in a position 60'. The pairs of toothed belts 60 are each moved via drive rollers 601, 602, which via a rack (not shown here) are moved from the position 60 to the position 60' in a manner analogous to the transport rollers 17. From that position, the folded sheets 9 are transported onward via guide tongues 61 (FIG. 3) and delivered for instance to an apparatus for stacking printed products, of the kind known from U.S. Pat. No. 5,129,781.

Figure 10:
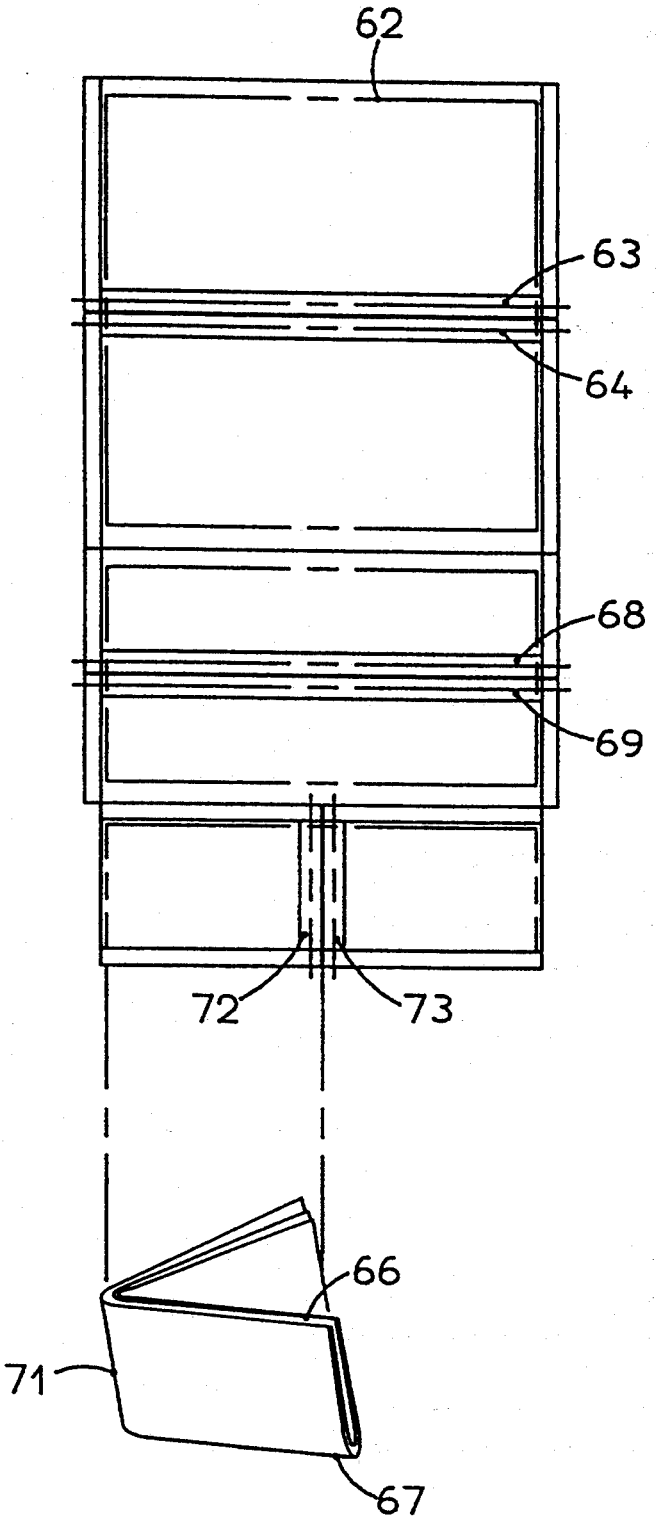
FIG. 10 is a schematic view of folding units connected next to one another.
Figure 11:
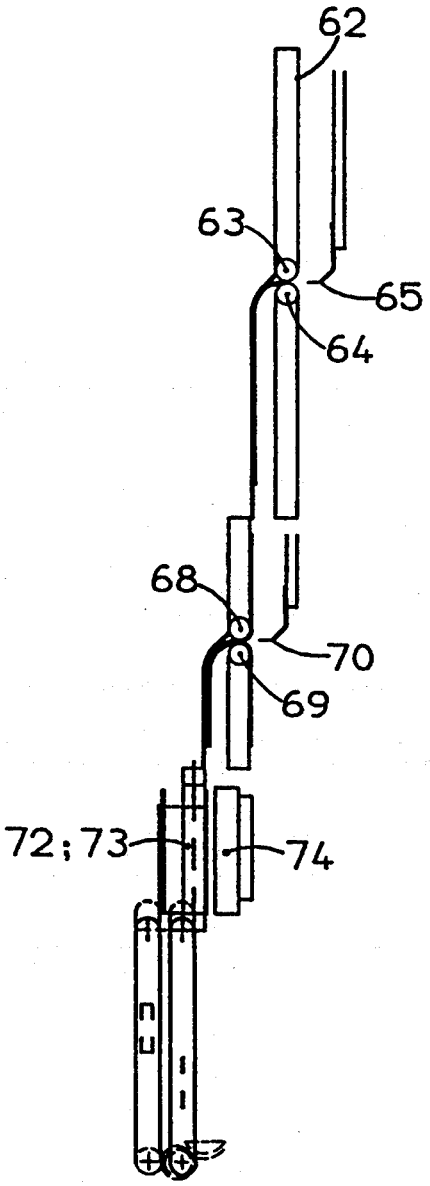
FIG. 11 is a further schematic view of folding units connected next to one another.

Folding units which are designed like the folding units 8 described in conjunction with FIGS. 1–9 can be connected one after the other in order to re-fold the folded sheets 9 multiple times. In a first folding unit, with the aid of folding rollers 63, 64 and a folding blade 65 (FIG. 11), a folded sheet 62 (FIG. 10) receives its first crosswise fold along a fold line 66 (FIG. 10). Next it receives a second crosswise fold along a fold line 67 with the aid of a second folding station that has folding rollers 68, 69 and a folding blade 70 (FIGS. 10, 11). In a third folding station, a lengthwise fold is made along a fold line 71 (FIG. 10) by means of folding rollers 72, 73 (FIGS. 10, 11) and a folding blade 74 (FIG. 11). Such folding stations can be set up one after another in an arbitrary order.

In this way, a number of folding stations 8 operate in parallel according to the invention; they are simple in design and simultaneously process a high number of folded sheets 9. Compared with a folding apparatus that operates purely serially, there is more time available for each folding process in the parallel-operation folding apparatus, so that this process can be controlled accurately. By connecting folding stations one after the other, in the way shown in FIGS. 10, 11, arbitrary special folds can be created.

Various modifications which are readily apparent to one with ordinary skill in the art may be made to the preferred embodiments described in detail above, and features described in connection with any one of the embodiments may be used with any of the others. For example, rails 36, 47, 48 and 58, as well as folding blades 47, can be driven from a common drive or respectively singly by electric motors, such as positioning motors. All such modifications are intended to fall within the scope of the present invention as defined by the following claims.

I claim:

1. A folding apparatus for a web-fed rotary printing press, to which sheets that are to be folded can be delivered serially in a given direction, comprising:

a plurality of folding units (8);

means for delivering a plurality of the folded sheets to the folding units (8) in parallel, respectively, in a direction substantially perpendicular to the given direction of serial delivery so that each folding unit receives at least one sheet arranged to have its surface face a surface of at least one sheet received in a adjacent folding unit; and means in the folding units for folding the plurality of sheets delivered in parallel to the folding units substantially simultaneously, with a maximum number of parallel-deliverable sheets (9) corresponding to the number of said folding units (8).

2. The folding apparatus of claim 1, further comprising a gripper chain (3) for serially delivering the folded or unfolded sheets (9) from a stack (2).

3. The folding apparatus of claim 1, further comprising carrier structures (10, 11) for delivering the folded or unfolded sheets (9) from storage cassettes (140).

4. The folding apparatus of claim 1, wherein a portion of the folded or unfolded sheets (9) are clamped between plates (23, 24) during the folding by said folding means.

5. The folding apparatus of claim 4, wherein the folding units (8) have laterally movable folding rollers (39) respectively.

6. The folding apparatus of claim 5, further comprising a pneumatic cylinder (46) for laterally moving the folding rollers (39) of each of said folding units (8).

7. The folding apparatus of claim 6, wherein each of the folding units (8) includes a folding blade (47), and pinion (50) and rack for adjusting the position of said folding blade relative to said folded or unfolded sheets (9).

8. The folding apparatus of claim 7, wherein the folding blades (47) in said folding units (8) are secured jointly to a rail (49), and each of said folding blades includes a bent end for driving into the folded or unfolded sheets (9).

9. The folding apparatus of claim 1, further comprising other folding units following said folding units (8) to produce further folds.

10. The folding apparatus of claim 1, wherein the folding units (8) have laterally movable folding rollers (39) respectively.

11. The folding apparatus of claim 10, further comprising a pneumatic cylinder (46) for laterally moving the folding rollers (39) of each of said folding units (8).

12. The folding apparatus of claim 11, wherein each of the folding units (8) includes a folding blade (47), and pinion (50) and rack for adjusting the position of said folding blade relative to said folded or unfolded sheets (9).

13. The folding apparatus of claim 12, wherein the folding blades (47) in said folding units (8) are secured jointly to a rail (49), and each of said folding blades includes a bent end for driving into the folded or unfolded sheets (9).

14. The folding apparatus of claim 1, wherein each of the folding units (8) includes a folding blade (47), and pinion (50) and rack for adjusting the position of said folding blade relative to said folded or unfolded sheets (9).

15. The folding apparatus of claim 14, wherein the folding blades (47) in said folding units (8) are secured jointly to a rail (49), and each of said folding blades includes a bent end for driving into the folded or unfolded sheets (9).

16. A folding apparatus for a web-fed rotary printing press, to which folded or unfolded sheets (9) that are to be folded can be delivered serially in a given direction, comprising:

a plurality of folding units (8);

means for delivering a plurality of the folded or unfolded sheets to the folding units (8) in parallel, respectively, in a direction substantially perpendicular to the given direction of serial delivery;

means in the folding units for folding the plurality of folded or unfolded sheets substantially simultaneously, with a maximum number of parallel-deliverable folded or unfolded sheets (9) matching the number of said folding units (8);

wherein a portion of the folded or unfolded sheets (9) are clamped between plates (23, 24) during the folding by said folding means;

wherein the folding units (8) have laterally movable folding rollers (39), respectively, and a pneumatic cylinder (46) for laterally moving the folding rollers (39) of each of said folding units (8);

wherein each of the folding units (8) includes a folding blade (47), and pinion (50) and rack for adjusting the position of said folding blade relative to said folded or unfolded sheets (9); and wherein the folding blades (47) in said folding units (8) are secured jointly to a rail (49), and each of said folding blades includes a bent end for driving into the folded or unfolded sheets (9).

17. A folding apparatus for a web-fed rotary printing press, to which folded or unfolded sheets (9) that are to be folded can be delivered serially in a given direction, comprising:

a plurality of folding units (8) having laterally movable folding rollers (39), respectively, wherein each of the folding units (8) includes a folding blade (47), and pinion (50) and rack for adjusting the position of said folding blade relative to said folded or unfolded sheets (9) and wherein the folding blades (47) in said folding units (8) are secured jointly to a rail (49), and each of said folding blades includes a bent end for driving into the folded or unfolded sheets (9);

means for delivering a plurality of the folded or unfolded sheets to the folding units (8) in parallel, respectively, in a direction substantially perpendicular to the given direction of serial delivery;

means in the folding units for folding the plurality of folded or unfolded sheets substantially simultaneously, with a maximum number of parallel-deliverable folded or unfolded sheets (9) matching the number of said folding units (8); and a pneumatic cylinder (46) for laterally moving the folding rollers (39) of each of said folding units (8).

18. A folding apparatus for a web-fed rotary printing press, to which folded or unfolded sheets (9) that are to be folded can be delivered serially in a given direction, comprising:

a plurality of folding units (8) each including a folding blade (47), and pinion (50) and rack for adjusting the position of said folding blade relative to said folded or unfolded sheets (9), wherein the folding blades (47) in said folding units (8) are secured jointly to a rail (49), and each of said folding blades includes a bent end for driving into the folded or unfolded sheets (9);

means for delivering a plurality of the folded or unfolded sheets to the folding units (8) in parallel, respectively, in a direction substantially perpendicular to the given direction of serial delivery;

means in the folding units for folding the plurality of folded or unfolded sheets substantially simultaneously, with a maximum number of parallel-deliverable folded or unfolded sheets (9) matching the number of said folding units (8).

* * * * *